US006623042B1

(12) United States Patent
Jürgen et al.

(10) Patent No.: US 6,623,042 B1
(45) Date of Patent: Sep. 23, 2003

(54) VISUALLY IDENTIFIABLE OPTICAL ELEMENT

(75) Inventors: Herrmann Jürgen, Alsbach; Reinhart Werner, Nürnberg; Stange Thomas, Bruchköbel, all of (DE)

(73) Assignees: Leonhard Kurz, GmbH & Co., Furth (DE); Deutsche Bundesbank, Frankfurt (DE)

( * ) Notice: Subject to any disclaimer, the term of this patent is extended or adjusted under 35 U.S.C. 154(b) by 0 days.

(21) Appl. No.: 08/793,520

(22) PCT Filed: Aug. 31, 1995

(86) PCT No.: PCT/DE95/01193

§ 371 (c)(1),
(2), (4) Date: Feb. 5, 2001

(87) PCT Pub. No.: WO96/07547

PCT Pub. Date: Mar. 14, 1996

(30) Foreign Application Priority Data

Sep. 9, 1994 (DE) ..... 44 32 062

(51) Int. Cl.[7] ..... B42D 15/00

(52) U.S. Cl. ..... 283/91; 283/92; 283/72; 428/913

(58) Field of Search ..... 428/29, 30, 913; 283/67, 70, 72, 86, 91, 92, 93, 901, 904

(56) References Cited

U.S. PATENT DOCUMENTS 4,568,141 A * 2/1986 Antes ..... 283/91
4,984,824 A * 1/1991 Antes et al. ..... 283/91
5,142,383 A * 8/1992 Mallik ..... 283/91 X
5,763,051 A * 6/1998 Reinhart eta l. ..... 283/91 X
6,234,537 B1 * 5/2001 Gutmann et al. ..... 283/91 X

* cited by examiner

*Primary Examiner*—Willmon Fridie, Jr.
(74) *Attorney, Agent, or Firm*—Hoffmann & Baron, LLP

(57) ABSTRACT

So that a visually identifiable optical element, in particular a security element for value-bearing documents, for example banknotes, credit cards, passes or cheque documents, or other articles to be safeguarded, comprising a carrier with a diffusely reflecting visible surface and a metallization which is applied in a region-wise manner to the visible surface of the carrier and which has a surface that appears metallically shiny at a glancing angle is improved in such a way that an article provided with the element is even more effectively protected from forgery than is possible with known optical elements, it is proposed that the optical element is so designed that the visible surface of the carrier has two carrier regions with different levels of and in particular diffuse reflectivity for light, wherein a respective sub-region or a plurality of sub-regions of each of the two carrier regions is or are metallized, and that the reflectivity of the metallization in viewing directions outside a glancing angle range is less than the reflectivity of the carrier region with the higher level of reflectivity or substantially corresponds to same and is greater than the reflectivity of the carrier region with the lower level of reflectivity or substantially corresponds to same.

20 Claims, 2 Drawing Sheets

VISUALLY IDENTIFIABLE OPTICAL ELEMENT

BACKGROUND OF THE INVENTION

The invention concerns a visually identifiable optical element, in particular a security element for value-bearing documents, for example banknotes, credit cards, passes or cheque documents, or other items to be safeguarded, including a carrier having an in particular diffusely reflecting visible surface and a metallisation applied in a region-wise manner to the visible surface of the carrier, with a surface which appears metallically shining at a glancing angle.

In known optical elements the metallisation appears either light or dark, in front of the background for the metallisation, the background being formed by the carrier. Such an optical element is described for example in WO 93/01057.

The use of a carrier with a metallisation as a visually identifiable optical element for security or decorative purposes is based on the physically explainable phenomenon that light which impinges from a given direction onto a smooth metal surface can be perceived by a viewer in the form of reflected light at a given viewing direction. If on the other hand the light is not incident from a single given direction but if the light for example involves diffusely incident daylight or light from a diffuse light source, then, in dependence on the orientation of the metallised region relative to the range of angle of incidence of the light, that gives a viewing angle range, referred to hereinafter as the glancing angle range, from which a viewer perceives the metallisation as being highly shiny and metallically bright, as a large part of the light which meets the metallisation within the range of the angle of incidence is reflected into that glancing angle range. The reflectivity which is dependent on the viewing angle is thus particularly high in that glancing angle range which is determined by the range of the angle of incidence of the light, in other words, a large part of the radiant energy which passes onto the unit of surface area of the metallisation is reflected into that glancing angle range. In contrast, for viewing directions outside the glancing angle range, the metallisation does not appear shiny to a viewer, but it gives a metallically grey and matt colour impression. In dependence on the light reflectivity of the carrier, that matt colour impression appears either light or dark, relative to the background.

The term metallisation is used hereinafter to denote a layer of any structure, which in particular is very thin, having a metallically shiny surface.

When using visually identifiable optical elements or security elements, the endeavour is to provide that items of authenticity information in respect of the safeguarded article are rendered visible, even to the unpractised lay person, and at the same time forgery, for example in the form of duplication, having regard to known forgery procedures, in particular optical duplication procedures, is made impossible or is made at least sufficiently difficult. Optical elements of that kind however are also used for decorative purposes.

SUMMARY OF THE INVENTION

The object of the present invention therefore is to provide an optical element of the kind described in the opening part of this specification, which is easy to produce in an economical fashion and with which an article to be safeguarded can be protected from forgery even more effectively than is possible with known security elements.

In an optical element as described in the opening part of this specification, in accordance with the invention, that object is attained in that the visible surface of the carrier has two carrier regions having different levels of and in particular diffuse reflectivity for light wherein a respective sub-region or a plurality of sub-regions of each of the carrier regions is or are metallised, and that the reflectivity of the metallisation is lower in viewing directions outside a glancing angle range than the reflectivity of the carrier region having the higher level of reflectivity or substantially corresponds to same and is greater than the reflectivity of the carrier region having the lower level of reflectivity or substantially corresponds to same.

By virtue of the fact that the carrier is divided into at least one region of higher light reflectivity and a region of lower light reflectivity and the levels of reflectivity of those carrier regions and the metallisation satisfy the conditions described above, the visually perceptible information which can be imparted to a viewer by means of the optical element is more varied and diverse, in dependence on the viewing angle; thus, in a given viewing angle, outside the glancing angle range, a metallised sub-region appears dark in front of the background which is formed by the carrier region having the higher level of reflectivity, while another metallised sub-region appears light in front of the background which is formed by the carrier region having the lower level of reflectivity, if the reflectivity of the metallisation is lower in the. first case and greater in the second case, than the reflectivity of the respective carrier region being viewed.

If the reflectivity of the metallisation in a viewing direction outside the glancing angle range substantially corresponds to the reflectivity of the dark carrier region, that is to say if it is not possible to detect a difference in the reflection capability with the naked eye, the metallised sub-region of that carrier region is not perceptible or is scarcely perceptible in front of the background, when viewing outside the glancing angle range. If on the other hand the security element is viewed in the glancing angle range of the metallisation, which is determined by the range of the angle of incidence of the light, the metallisation appears metallically shinny bright relative to both carrier regions. A corresponding consideration applies if the reflectivity of the metallisation, when viewed in a viewing direction outside the glancing angle range, substantially corresponds to the diffuse reflectivity of the bright carrier region.

In that respect, production of the optical element according to the invention is made more difficult only in a fashion which is not worthy of mention, in comparison with the production of known elements. Thus for example one half of the carrier can be adapted to appear white, in particular with a visible surface of diffusely reflecting white paper, while the other half of the carrier can be coloured black with a level of reflectivity which accordingly can be disregarded.

The portion of the metallisation which is applied to the black region of the carrier, therefore to the region having the lower level of reflectivity, appears, in front of that dark background, as a matt metallic light-grey colour shade. The portion of the metallisation which is applied to the white carrier region and therefore to the carrier region having the higher level of reflectivity on the other hand appears, in front of that light background, as a matt metallic dark-grey shade and stands out from the light background, by appearing dark. If now the optical element is so oriented, with respect to the direction of the light impinging thereon, that a viewer has the element or the metallised region in front of his eyes in the above-mentioned glancing angle range, the portion of the metallisation which partially covers the white region of the carrier no longer appears dark but appears brilliantly shiny and gleamingly bright. The portion of the metallisation which is applied to the black region of the carrier also appears metallically shinily bright when it is viewed in a viewing direction within the glancing angle range. In this case also the visually perceptible information changes when the orientation of the element or the viewing direction is altered.

Admittedly, by the use of a carrier with a white and a black region, the optical element according to the invention can be produced in a particularly simple and economical fashion, but it can also be found advantageous to better fulfill in particular aesthetic considerations, if the at least two regions on the visible surface of the carrier are designed in a different way. There is a wide range of possible variations here, within the limits of the teaching afforded by the invention. For example the region of higher light reflectivity may have a light colour shade and the region of lower reflectivity may have a dark colour shade. It is only necessary to ensure that the above-specified relationships in regard to the levels of reflectivity of the respective surrounding regions of the carrier and the metallisation respectively are maintained. In particular if the visible surface of the carrier region of lower reflectivity is to appear as a dark-grey colour shade it is possible for the optical element to be so designed that the reflectivity of the metallisation substantially corresponds to the diffuse reflectivity of the dark-grey background, so that the metallisation does not stand out from the dark-grey background for viewing directions which lie outside the glancing angle range, but only becomes visible to a viewer, when viewed within the glancing angle range.

It will be appreciated that the region-wise metallisation of the respective carrier regions can be of any shape, that is to say it can also be applied to the carrier, in the form of characters or symbols.

In the simplest case, the region-wise metallisation of the carrier regions can be embodied by a single, coherent portion of a metal layer of any geometrical shape, which is applied to the carrier region, covering over the boundary between the light and the dark carrier region. It is however also possible for a plurality of sub-regions and in particular a multiplicity of sub-regions of the two carrier regions to be metallised; thus, the metallisation can be applied to the carrier, forming a visually perceptible pattern. In that respect, the pattern can cover over the carrier, in the form of regularly arranged sub-regions of any geometrical shape, in which case the background always remains visible between the metallised sub-regions. In that respect, it can be found to be particularly advantageous that the metallisation is applied to the carrier in the form of a dot or line grid pattern which produces a visually perceptible half-tone image.

In order further to increase the number of the items of information which can be transmitted by means of the optical element and in order thus more effectively to communicate items of information about a safeguarded article and at the same time to make it more difficult to forge the optical element or the safeguarded article, it is found to be advantageous for the carrier to have a plurality of regions of the same reflectivity. That can be embodied In a very simple manner in that for example a square carrier or carrier portion is divided by a notional vertical line and a horizontal line into four square portions, of which the portions disposed on a respective diagonal are of an identical configuration and form the carrier region having the higher or lower level of reflectivity. It will also be appreciated that any other conceivable ways of dividing the carrier into regions of higher and lower levels of light reflectivity are embraced by the teaching according to the invention.

Optical elements according to the invention may also include more than two carrier regions or groups of carrier regions of different reflectivity. The relationships in regard to the levels of reflectivity of the individual carrier regions and the associated metallisations are then to be applied accordingly.

In a particularly preferred embodiment of the optical element at least one of the carrier regions is provided with a differing level of reflectivity which in turn varies in dependence on the viewing angle. In other words, upon a change in the viewing angle, for example by pivoting the carrier about an axis which is disposed in its plane, there is not only a change in the reflectivity of the metallisation, for example by virtue of a transition into the glancing angle range or by departing from the glancing angle range, but there Is also a change in the reflectivity of the carrier region surrounding the metallisation. For that purpose the visible surface of the carrier region can be covered with an optically effective thin-film coating which for example imparts a white colour impression for certain viewing directions and for example a colour impression that appears as green, for other viewing directions. It is however also conceivable for the visible surface of the carrier region to be of such a nature, by virtue of a suitable coating thereon, that the coating appears transparent for viewing directions outside the glancing angle range and thus the reflectivity of the visible region of the carrier is determined by the carrier region which is under the coating, while in another viewing angle range, in particular in the glancing angle range, the coating forms a coloured, for example violet background for the metallisation.

In a further embodiment of the invention, it is proposed that, instead of two carrier regions which are spatially separated from each other, with different levels of reflectivity, there is a carrier region with a reflectivity which is of a different level and which varies in dependence on the lighting or viewing angle, that carrier region being such that, outside the glancing angle range of the metallisation, there are viewing directions in which the reflectivity of the metallisation is less than the reflectivity of the carrier region or substantially corresponds to same, and that there exist other viewing directions in which the reflectivity of the metallisation is greater than the reflectivity of the carrier region or substantially corresponds to same.

The effect produced at first by the provision of two carrier regions with different levels of reflectivity, namely that a metallisation appears on the one hand light and on the other hand dark, depending on the background in front of which it is viewed, can be produced, in the case of an optical element designed as described above, by varying the viewing angle. Thus, it is possible for the carrier to be such that, in a viewing direction outside the glancing angle range, the metallisation appears dark relative to the background which is formed by the visible surface of the carrier, and that, in another viewing direction, the metallisation appears light in front of the carrier background, and in particular the carrier appears in a different colour from that in which it appears in the first-mentioned viewing direction. It is also possible for the optical element to be such that a change in the reflectivity or the colour of the carrier can be observed when the viewing direction moves into the glancing angle range of the metallisation or when it moves out of the glancing angle range.

Such effects can be achieved over a wide range of variations, for example by widely varying, optically effective thin-film coatings on the visible surface of the carrier. An optical element can therefore be so designed that not only is it possible to provide a transition from a condition with a metallisation which appears dark against the background, into a condition with a metallisation which appears light against the background, but in that respect, at the same time, there is a change in the colour impression originating from the carrier, for example from white to violet.

It is also possible to envisage carrier region coatings which, in viewing directions outside the glancing angle range of the metallisation, appear transparent, and thus do not or scarcely influence the reflectivity of the carrier as well as the light/dark and the dark/light contrast of the metallisation in relation to the carrier, but which, in viewing directions within the glancing angle range, form a coloured, optically perceptible background for the metallisation.

The optical effectiveness of the carrier coating can be based on per se known physical effects such as extinction or superimposition of light waves, or on the chemical composition of the substances used for this purpose.

In a further preferred embodiment of the optical element, structures producing diffraction and/or interference are integrated into the metallisation. By virtue of the incorporation of such structures, which are also to be referred to as diffraction structures, into the metallically shiny surface regions, spectral colour effects can additionally be observed in diffraction angles which are determined by the structure and the frequencies of the incident light, in particular also outside the actual glancing angle range. An optical element of such a configuration additional items of information and is therefore even more secure in regard to forgeability thereof.

In a still more comprehensive configuration of the invention, it is proposed that the optical element is so designed that the metallisation includes a metallically shiny relief-like structure comprising raised portions which are elongated in substantially mutually parallel relationship, and that the troughs between the raised portions have a surface structure which imparts a metallically matt image impression. When an optical element of such a configuration is viewed in a direction substantially perpendicularly to the linearly elongated raised portions, the metallisation, within its glancing angle range, is perceptible as metallically shinily bright. In contrast, in a viewing direction substantially parallel to the linearly extended raised portions, the surface structure provided in the troughs between the raised portions acts in the form of an image impression which appears matt. Thus, when viewing the metallisation within the glancing angle range, it is possible, by turning the optical element about an axis which extends perpendicular to the plane of the carrier, to change from an image impression which appears metallically shiny, to an image impression which appears metallically matt, or vice versa.

The invention also concerns a value-bearing document carrier, in particular in the form of a portion of a web of flat material, for example of paper or plastic material, which has been improved in regard to its anti-forgery security, by virtue of the fact that it has a security element according to the invention. In preferred value-bearing document carriers, the carrier of the security element is formed by the value-bearing document carrier itself.

BRIEF DESCRIPTION OF THE DRAWINGS

Further features, advantages and details of the invention are apparent from the accompanying drawing and from the following description of-advantageous embodiments of the optical element according to the invention. In the drawing.

DESCRIPTION OF THE PREFERRED EMBODIMENTS

Figure 1:
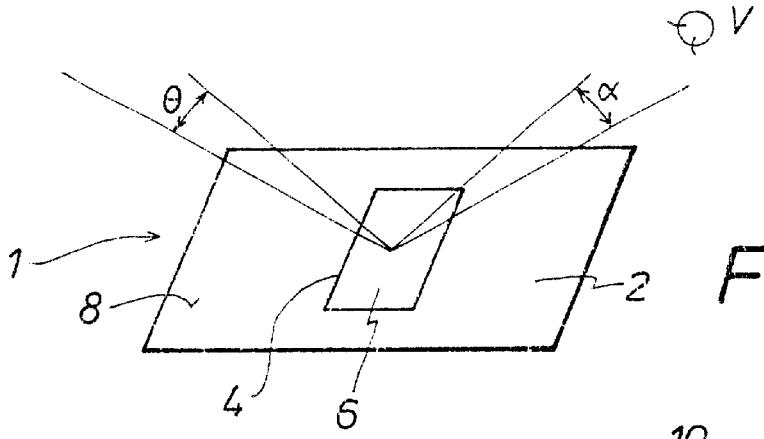
FIG. 1 is a diagrammatic view showing the principle of a known optical element.

FIG. 1 shows an optical element which is fundamentally known, being generally identified by reference numeral 1 and being used as a security element. The optical element 1 Includes a flat extensive carrier 2 having a sub-region 4 to which a metallisation 6 (not shown in detail) is applied. The metallisation 6 can be formed from a homogenous metal layer or it can be formed by metallic grid pattern dots which generate a half-tone image. The carrier 2 has for example an optically bright, diffusely reflecting visible surface 8 which is towards a viewer V and which forms the background for the metallisation 6, but which in turn can also include items of information, for example in the form of water marks, thin hatching lines, etc. If light impinges on the element 1 or the metallisation 6 within a range of angle of incidence gamma from an in particular diffuse light source or in the form of diffuse daylight which enters through a window, then a large part of the incident light can be perceived in the form of reflected light within a glancing angle range alpha. The metallisation then appears to be highly shiny and stands out as metallically shiny and of bright appearance, from the visible surface 8 of the carrier 2; the visible surface 8 is admittedly optically bright but it provides diffuse reflection. In contrast, in viewing directions outside the glancing angle range alpha the metallisation 6 imparts a matt, metallic dark-grey colour shade which stands out as dark in front of the optically bright background of the carrier 2.

Figure 2:
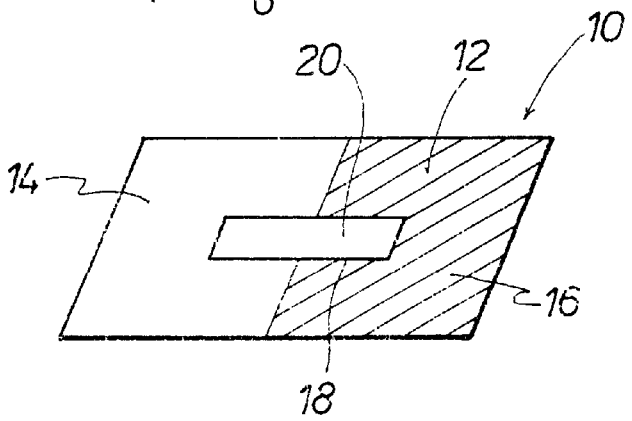
FIG. 2 is a diagrammatic view of an optical element according to the invention.

FIG. 2 shows a first embodiment of the optical element according to the invention. It includes a carrier 10 whose visible surface 12 is divided into a region 14 with a high level of diffuse light reflectivity (sigmaT,>) and a region 16 with a low level of diffuse light reflectivity (sigmaT,<). The region 14 conveys a white colour impression and therefore reflects the frequencies of the visible spectrum equally, while the region 16 absorbs the visible light and therefore appears black. The regions 14, 16 may also in turn include items of information. Reference numeral 18 indicates a sub-region of the carrier 10 to which a metallisation 20 is applied in a manner not shown in greater detail herein. In that respect, half of the metallisation 20 or the sub-region 18 is disposed in the light region 14 while the other half is in the dark region 16. The metallisation 20 has a reflectivity sigmaM which, in a viewing direction outside its glancing angle range described in connection with FIG. 1, is less than the reflectivity sigmaT,> of the region 14 with the higher level of reflectivity, but it is higher than the reflectivity sigmaT,< of the region 16 with the low level of reflectivity. When the sub-region 18 is viewed from a direction which, having regard to the incident light, lies outside the glancing angle range, the metallisation 20 appears dark in front of the light background of the region 14, while the portion of the metallisation 20, which is applied to the dark carrier region 16, appears light. Accordingly, items of optical information which are different from each other can be conveyed to a viewer by means of one and the same metallisation. In viewing directions within the glancing angle range the metallisation appears light relative to both carrier regions 14, 16 as the reflectivity of a smooth metallic surface within its glancing angle range is greater than the reflectivity of the diffusely reflecting carrier.

Figure 3:
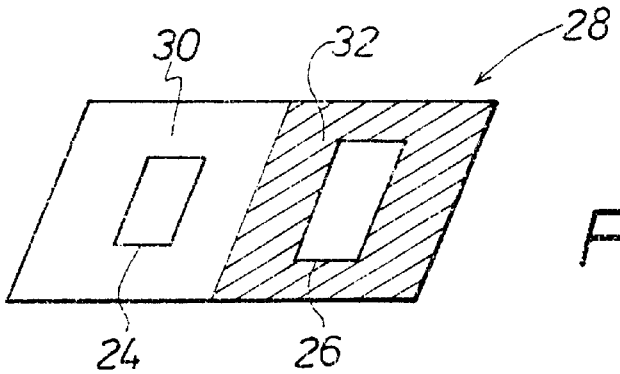
FIG. 3 is a diagrammatic view of a further embodiment of the optical element according to the invention.

FIG. 3 shows another embodiment of the optical element according to the invention, which differs from the embodiment shown in FIG. 2 in that, instead of a coherent metallisation 20 which covers in a region-wise manner the two carrier regions of different levels of reflectivity, there are two metallised sub-regions 24, 26, on a carrier 28. The sub-region 24 is within a light carrier region 30 and the sub-region 26 is within a dark carrier region 32. With that optical element, by means of the same metallisation, it is possible to communicate two different items of visually perceptible information which come from spatially separated regions of the carrier. The sub-regions 24, 26 may also be in the shape of different symbols.

Figure 4:
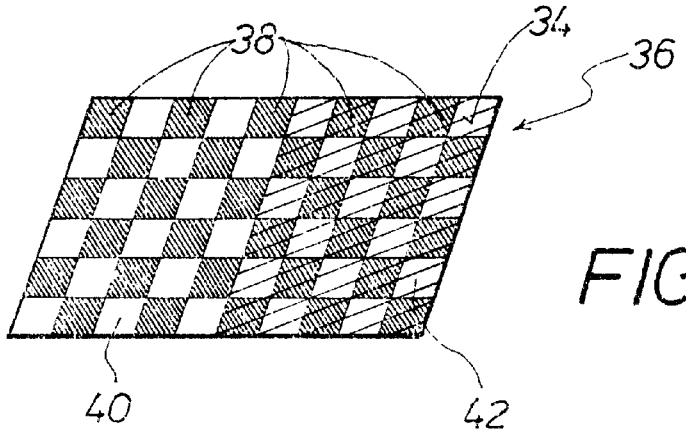
FIG. 4 is a diagrammatic view of a third embodiment of the optical element according to the invention with a metallisation in pattern form.

FIG. 4 shows a particularly preferred embodiment of the optical element according to the invention. In the illustrated case, the metallisation is applied to the carrier in the form of a regular pattern which covers over the visible surface 34 of a carrier 36. The pattern is formed by metallised square sub-regions 38 which touch each other at the corners in the manner of a chessboard pattern. In viewing directions outside the glancing angle range, in front of the light background of a carrier region 40 with a high level of reflectivity, the metallised sub-regions 38 appear dark. In the illustrated case, a carrier region 42 with a low level of light reflectivity has a visible surface of such a grey shade that, in a viewing direction outside the glancing angle range alpha the metallised sub-regions 38 which cover over that carrier region 42 do not stand out from the grey background and therefore cannot be perceived by a viewer (this is not shown here however). In this case, the reflectivity of the metallisation sigmaM substantially corresponds to the reflectivity sigmaT,< of the carrier region 42. The carrier region 42 therefore appears grey over its entire extent. The pattern shown in FIG. 4 can only be perceived on the carrier region 42 when the carrier region 42 is viewed in a direction within the glancing angle range. Such a security element can be reliably handled and understood, even by an unskilled lay person.

Figure 5:
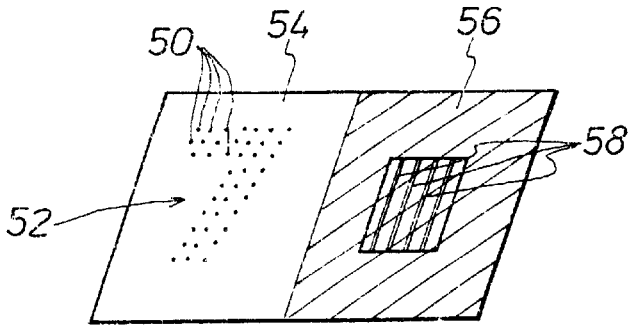
FIG. 5 is a diagrammatic view of a fourth embodiment of the optical element according to the invention with a metallisation in the form of dot and line grid patterns.

As is clear from FIG. 5, the metallisation can also be formed by different forms of dot or line grid patterns which produce a half-tone image 52. In the Illustrated case, the pattern dots 50 are applied to a carrier region 54 with a high level of light reflectivity. Applied to a carrier region 56 with a low level of light reflectivity is a metallisation in a form of a line pattern of strips 58 which extend substantially parallel to each other. A visually perceptible half-tone image is produced by varying the width of the lines or strips 58 over their longitudinal extent.

Figure 6:
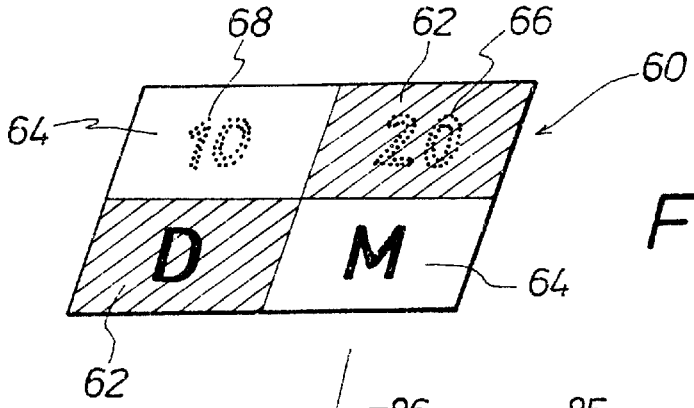
FIG. 6 is a diagrammatic view of a fifth embodiment of the optical element according to the invention with a plurality of carrier regions having the same reflectivity.

FIG. 6 shows a further preferred embodiment of the optical element according to the invention, in which a carrier 60 is divided into a plurality of regions 62 and 64 respectively of equal reflectivity. Th regions indicated by reference numeral 62 have a lower level of reflectivity and therefore appear dark while the regions 64 have a high level of reflectivity and consequently appear light. In the regions 62 and 64 arranged at the top in FIG. 6, there is a metallisation 66 and 68 respectively, in the form of metallic pattern dots which combine to form digits. In the carrier regions 62 and 64 which are arranged at the bottom in FIG. 6, a metallisation is applied to the carrier 60, in each case in the form of a letter. When the element is viewed outside the glancing angle range the letter "D" appears light in front of the dark background of the carrier region 62 while the letter "M" appears dark in front of the light background of the carrier region 64.

The optical elements shown in FIGS. 2 to 6 or the visible surfaces of the carrier regions 14, 16, 30, 32, 40, 42 can be of such a nature and configuration, for example by means of an optically effective thin-film coating, that their reflectivity alters in dependence on the lighting or viewing angle. It is possible for example that the carrier region 64 of the carrier 60 shown in FIG. 6 appears white in a given viewing direction, whereas in another viewing direction, it forms a coloured background for the patterned metallisation 68.

If, before the metallisation in pattern form is applied to the sub-region of the carrier region 64, which is to be metallised and which is in the form of the number "10", that sub-region is optically darkened, in particular blackened, it is possible for the patterning to be such that, in the glancing angle range, the reflectivity of the patterned metallisation 68 substantially corresponds to the reflectivity of the carrier region 64 so that, in the glancing angle range, the symbol represented by the patterned metallisation is not perceptible or is scarcely perceptible.

It is further possible for structures which have an optical-diffraction effect to be integrated into the metallised sub-regions of the optical elements shown in FIG. 2 to 6. In the diffraction angles, in particular outside the actual glancing angle range, it is then possible to observe defined spectral colour effects which, as additional authenticity information, make it more difficult to forge the article to be safeguarded.

Figure 7:
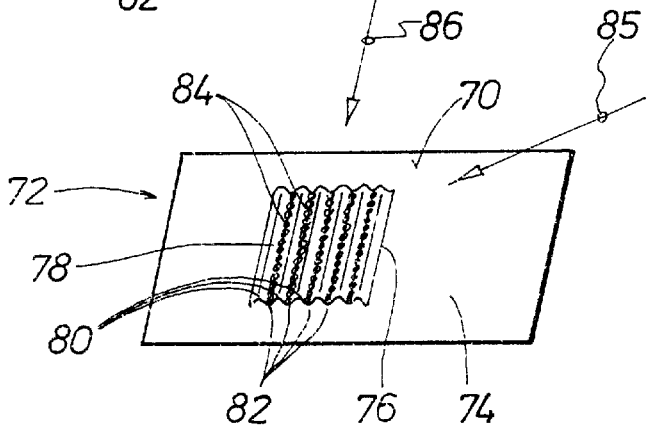
FIG. 7 is a diagrammatic view of a sixth embodiment of the optical element according to the invention with a carrier region of varying reflectivity and with a metallisation which has structures.

FIG. 7 shows a further advantageous embodiment of the optical element according to the invention, in which a carrier region 74 which forms the entire visible surface 70 of a carrier 72 is of such a configuration, by virtue of a suitable, optically effective thin-film coating, in particular a special-effect pigment, that it exhibits varying reflectivity in dependence on the lighting or viewing angle; thus, when viewed in a first viewing direction the carrier region 74 conveys a first colour impression and, when viewed in a second viewing direction, it conveys a colour impression of a different colour. A sub-region 76 of the carrier region 74 carries a metallisation 78 which appears dark relative to the carrier region 74, in a viewing angle range outside its glancing angle range alpha while in another viewing direction, in particular within its glancing angle range, it appears light. The surface of the metallisation 78 includes relief-like metallically shiny raised portions 80 which are extended substantially parallel to each other, while troughs 82 between the raised portions 80 have a surface structure 84 which conveys a metallically matt image impression. When the optical element is viewed in a direction within the glancing angle range alpha and substantially perpendicularly to the linearly extended raised portions, the metallisation 78 appears metallically shinily bright. In a viewing direction substantially parallel to the raised portions 80, the surface structure 84 provided in the troughs 82 becomes visible and thus becomes optically effective so that a matt, metallically grey image impression is conveyed to a viewer.

Figure 8:
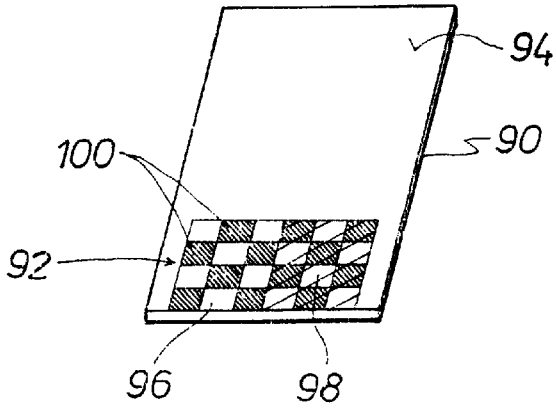
FIG. 8 is a diagrammatic view of a value-bearing document carrier with an optical security element according to the invention.

FIG. 8 shows a value-bearing document carrier 90 with a security element 92. The value-bearing document carrier 90 includes a web of flat plastic material, as is used in particular for the production of cheque cards or the like, and on its visible surface 94 it has a region 96 which appears light and a region 98 which appears dark, which regions are covered by a metallisation in the form of metallised sub-regions 100 arranged in a chessboard-like fashion. The mode of operation of this value-bearing document carrier 90 which is designed in accordance with the invention corresponds to the mode of operation of the optical elements described with reference to the foregoing Figures.

What is claimed is:

1. A visually identifiable optical element, in particular a security element for value-bearing documents, for example banknotes, credit cards, passes or check documents, or other items to be safeguarded, comprising a carrier having a reflecting and diffusely reflecting visible surface and a metallization applied in a region-wise manner to the visible surface of the carrier to form a metallized surface which appears metallically shining at a glancing angle, wherein the visible surface of the carrier has two carrier regions having different levels of reflectivity for light and diffuse reflectivity for light, wherein a first carrier region has a higher level of reflectivity ($\sigma_T$>) and a second carrier region has a lower level of reflectivity ($\sigma_T$<) relative to each other, wherein a respective sub-region or a plurality of sub-regions of each of the two carrier regions is or are metallized, and wherein the reflectivity ($\sigma_M$) of the metallization in viewing directions outside a glancing angle range ($\alpha$) is lower than the reflectivity of the carrier region having the higher level of reflectivity ($\sigma_T$>) or substantially corresponds to same and is greater than the reflectivity of the carrier region having the lower level of reflectivity ($\sigma_T$<) or substantially corresponds to same.

2. An optical element according to claim 1 wherein the metallization is applied to the carrier in the form of a dot or line grid pattern producing a visually perceptible half-tone image.

3. An optical element according to claim 1 characterized in that the metallization is applied to the carrier forming a visually perceptible pattern, a character, a symbol or a figure.

4. An optical element according to claim 3 wherein the metallization covers the carrier in the form of regularly arranged rhomboidal sub-regions.

5. An optical element according to claim 1 wherein the carrier has a plurality of regions of the same reflectivity.

6. An optical element according to claim 1 wherein the carrier has more than two regions with different levels of reflectivity.

7. An optical element according to claim 1 wherein metals of differing reflectivity are used for the region-wise metallization of the carrier regions with different levels of reflectivity.

8. An optical element according to claim 1 wherein at least one of the carrier regions is formed with a reflectivity which varies in dependence on the viewing angle.

9. A visually identifiable optical element, in particular a security element for value-bearing documents, for example banknotes, credit cards, passes or check documents, or other items to be safeguarded, including a carrier having a reflecting and diffusely reflecting visible surface and a metallization applied in a region-wise manner to the visible surface of the carrier to form a metallized surface which appears metallically shining at a glancing angle, wherein the visible surface of the carrier has a carrier region with a reflectivity which varies in dependence on the lighting or viewing angle and wherein the carrier is such that there are viewing directions outside a glancing angle range ($\alpha$), in which the reflectivity ($\sigma_M$) of the metallization is less than the reflectivity ($\sigma_T$) of the carrier region or substantially corresponds to same and wherein there exist other viewing directions in which the reflectivity ($\sigma_M$) of the metallization is greater than the reflectivity ($\sigma_T$) of the carrier region or substantially corresponds to same.

10. An optical element according to claim 9 wherein the carrier region has an optically effective thin-film coating.

11. An optical element according to claim 9 wherein structures producing diffraction and/or interference are integrated into the metallization.

12. An optical element according to claim 9 wherein the metallization includes metallically shiny raised portions which are extended substantially parallel to each other, and wherein the troughs between the raised portions have a surface structure which conveys a metallically matt image impression.

13. A value-bearing document carrier, in particular in the form of a web of flat material of paper or plastic, comprising an optical security element according to claim 1.

14. A value-bearing document carrier according to claim 13 wherein the carrier of the security element is formed by the value-bearing document carrier itself.

15. An optical element according to claim 1 wherein the carrier regions have an optically effective thin-film coating.

16. An optical element according to claim 1 wherein structures producing diffraction and/or interference are integrated into the metallization.

17. An optical element according to claim 1 wherein the metallization includes metallically shiny raised portions which are extended substantially parallel to each other, and wherein the troughs between the raised portions have a surface structure which conveys a metallically matt image impression.

18. An optical element according to claim 2 wherein the carrier has more than two regions with different levels of reflectivity.

19. A value-bearing document carrier, in particular in the form of a web of flat material of paper or plastic, comprising an optical security element according to claim 9.

20. A value-bearing document carrier according to claim 19 wherein the carrier of the security element is formed by the value-bearing document carrier itself.

* * * * *

UNITED STATES PATENT AND TRADEMARK OFFICE

CERTIFICATE OF CORRECTION

PATENT NO. : 6,623,042 B1
DATED : September 23, 2003
INVENTOR(S) : Jurgen et al.

It is certified that error appears in the above-identified patent and that said Letters Patent is hereby corrected as shown below:

Column 2,
Line 28, reads "the. first case and greater in the second case, than the" should read -- the first case and greater in the second case, than the --
Line 41, reads "cally shinny bright relative to both carrier regions. A corre-" should read -- cally shinily bright relative to both carrier regions. A corre- --

Column 3,
Line 59, reads "the same reflectivity. That can be embodied In a very simple" should read -- the same reflectivity. That can be embodied in a very simple --

Column 4,
Line 16, reads "there Is also a change in the reflectivity of the carrier region" should read -- there is also a change in the reflectivity of the carrier region --

Column 6,
Line 31, reads "Includes a flat extensive carrier 2 having a sub-region 4 to" should read -- includes a flat extensive carrier 2 having a sub-region 4 to --

Column 7,
Line 60, reads "produce a half-tone image 52. In the Illustrated case, the" should read -- produce a half-tone image 52. In the illustrated case, the --

Column 8,
Line 60, reads "tively of equal reflectivity. Th regions indicated by reference" should read -- tively of equal reflectivity. The regions indicated by reference --

Signed and Sealed this

Twenty-fourth Day of February, 2004

JON W. DUDAS
*Acting Director of the United States Patent and Trademark Office*